US005864965A

United States Patent [19]

Hansson et al.

[11] Patent Number: 5,864,965

[45] Date of Patent: Feb. 2, 1999

[54] WEB DRYING

[75] Inventors: Torbjörn Hansson, Vallentuna; Greger Olofsson, Nödinge, both of Sweden

[73] Assignee: Valmet-Karlstad AB, Karlstad, Sweden

[21] Appl. No.: 537,875

[22] PCT Filed: Apr. 29, 1994

[86] PCT No.: PCT/SE94/00387

§ 371 Date: Oct. 31, 1995

§ 102(e) Date: Oct. 31, 1995

[87] PCT Pub. No.: WO94/25671

PCT Pub. Date: Nov. 10, 1994

[30] Foreign Application Priority Data

May 3, 1993 [SE] Sweden ..... 9301512

[51] Int. Cl.[6] ..... D21F 5/00

[52] U.S. Cl. ..... 34/446; 34/453; 34/456; 34/117; 34/170; 34/125

[58] Field of Search ..... 34/446, 448, 452, 34/453, 456, 116, 117, 120, 125

[56] References Cited

U.S. PATENT DOCUMENTS

| | | | |
|---|---|---|---|
| 4,494,319 | 1/1985 | Rudt | 34/116 |
| 4,583,302 | 4/1986 | Smith | 34/116 |
| 4,680,873 | 7/1987 | Fellers et al. | 34/116 |
| 4,686,777 | 8/1987 | Cooke | 34/116 |
| 4,807,371 | 2/1989 | Wedel | 34/117 |
| 4,809,445 | 3/1989 | Meyer et al. | 34/120 X |
| 4,893,741 | 1/1990 | Heinzmann | 34/116 X |
| 5,397,438 | 3/1995 | Nyberg et al. | 34/116 X |
| 5,506,033 | 4/1996 | Smith | 428/192 |
| 5,542,193 | 8/1996 | Sims et al. | 34/117 |

FOREIGN PATENT DOCUMENTS

| | | |
|---|---|---|
| 40208 | 11/1981 | European Pat. Off. . |
| 238470 | 9/1987 | European Pat. Off. . |
| WO87/05063 | 8/1987 | WIPO . |
| WO 89/12138 | 12/1989 | WIPO . |
| WO 90/14467 | 11/1990 | WIPO . |

*Primary Examiner*—Henry A. Bennett
*Assistant Examiner*—Steve Gravini
*Attorney, Agent, or Firm*—Bell Seltzer Intellectual Property Law Group of Alston & Bird LLP

[57] ABSTRACT

When drying a paper web (4) in a dryer section (1) of a paper machine provided with drying cylinders (2, 3) and drying wires (5, 6), shrinkage of the paper web in cross direction is counteracted by applying forces at its edge portions (11). According to the invention partial vacuum is maintained along the edge portions of the web within substantially the entire free draw (10) and is applied from the side of the drying wire (5, 6) facing away from the web (4) so that the web is sucked firmly against the drying wire by forces greater than the contracting forces acting in cross direction, thereby counteracting shrinking, said partial vacuum being set within the interval 0.1–0.8 bar, preferably 0.2–0.5 bar.

62 Claims, 4 Drawing Sheets

(PRIOR ART)

WEB DRYING

The present invention relates to a method in drying a paper web in the dryer section of a paper machine comprising a plurality of drying cylinders for producing a web having substantially maintained width throughout the dryer section, said web, together with at least one drying wire or parts of a drying wire, runs in one or more free draws each extending between two rolls, at least one of which is a drying cylinder, a partial vacuum being maintained by suction means within the longitudinal edge portions of the web.

The expression "free draw" shall in the present context be understood as the distance that the web travels upon passage from a first roll to the next following roll, regardless of whether the web is supported by a drying wire or the like or travels unsupported in a so-called "open draw".

The invention also relates to a device in the dryer section of a paper machine for producing a paper web having substantially maintained width, said dryer section comprising a plurality of drying cylinders and at least one drying wire supporting the web, said drying wire or parts thereof and the web being arranged to run in one or more free draws, each extending between two rolls, at least one of which is a drying cylinder, said device comprising suction means arranged to maintain a partial vacuum within the longitudinal edge portions of the web. The most important application of the invention is in drying paper for use when the bending stiffness, tensile stiffness, tensile strength and compression strength are essential quality properties.

It is a well known phenomenon that a paper web has a tendency to shrink during drying. The physical reason for this has proved to be more that the fibres becomes thinner than that they become shorter. However, this means that at the point of intersection between crossed fibres, the fibres become wrinkled and the strength properties are thus greatly altered. Briefly it may be said that free shrinkage gives a tough material able to absorb a great deal of energy before rupturing, while the paper becomes relatively stiff if drying occurs under restricted shrinkage or even with a certain amount of stretch. Free drying is used, for instance, in the manufacture of sack paper. In this context the ability to withstand strain is important whereas the stiffness is of no great significance. Drying with restricted shrinkage is used, for instance, in the manufacture of paper for envelopes and corrugated fibreboard.

U.S. Pat. No. 4,807,371 describes an apparatus for retaining the lateral edges of a paper web close to a felt. The web and felt pass around a special vacuum roll situated between two drying cylinders so that a space is formed for a special box to be fitted at each end portion of the vacuum roll, the box having lateral walls facing towards and spaced from the felt so that pockets are formed that are laterally sealed by means of curtains of air or mechanical strips. A partial vacuum occurs in the pockets when the felt passes the boxes at high speed. This shall prevent the lateral edges of the web from becoming detached from the felt, which otherwise can lead to web flutter and the risk of wrinkling at the edges of the web. The partial vacuum in the pockets can be increased through the influence of said curtains of air or by placing the pockets in communication with the vacuum roll. The problem of shrinkage in the cross direction of the web is not touched upon in the patent specification and neither can the apparatus be used for such a purpose.

WO 87/05063 (PCT/US86/00364) also relates to a device to prevent web flutter in a pocket formed between a drying cylinder and the free draw of a felt travelling towards and around the drying cylinder and carrying a paper web. A vacuum manifold arrangement extends through the pocket across the felt and is in communication with an inner vacuum chamber formed by two convergently related walls provided with openings. The air driven into the pocket during operation is removed by being sucked in through said openings to the vacuum chamber and on to said manifold arrangement, which communicates with a vacuum source. For the device to function, thus, the air in the pocket must be able to pass between the felt and one of said walls to be drawn in through its walls. The outer web will thereafter not be affected by any suction forces via the intermediate felt. The problem of shrinkage in the cross direction of the web is not touched upon in the patent specification, neither can the device be used for such a purpose.

EP-0 040 208 describes an apparatus also intended to prevent the web being separated from a felt in a pressure section due to the air currents formed when the felt, together with the web, runs at high speed between drying cylinders arranged in upper and lower rows. A vacuum box is arranged in the space between two free draws of the felt and the web and has walls disposed at a small distance from the felt and the lower drying cylinder. The walls have openings arranged in rows across the felt and along the drying cylinder so that partial vacuum is generated in the four wedge-shaped pockets defined by the felt and three drying cylinders, and the web is drawn towards the felt with the aid of the partial vacuum. The patent specification does not touch upon the problem of shrinkage in cross direction, neither can the apparatus described be used for this purpose.

SE-8400678-2 describes a method for controlling shrinkage of a paper web by subjecting the web at dry solids contents of at most 25% during a certain drying interval, e.g. during passage of the free draw between two drying cylinders, to outwardly directed forces applied to the edges of the web. The outwardly directed forces can be effected, for instance, by compressed air being caused to flow at high speed from a blowing box on each side of the web at each edge portion via slits directed obliquely outwards toward the web. An outwardly directed force is produced by the friction against the paper web and shall prevent shrinkage of the web. The web may be provided with a band at each side in order to increase the friction forces between the air flow and the web.

WO 89/12138 (PCT/US89/02230) describes a method of keeping a web taut in order to control shrinkage of the web in cross direction by wrapping the web, together with a felt, around a rotatable vacuum guide roll arranged between two drying cylinders, the vacuum guide roll operating with a partial vacuum of 1.49–1.99 kPa. The felt is situated between the web and the vacuum guide roll so that the web is subjected to partial vacuum via the felt and is drawn to intimate contact with the felt when the web and felt pass around the vacuum guide roll.

WO 90/14467 (PCT/SE90/00325), corresponding to SE-8901775-0, describes a device in a dryer section intended to counteract shrinkage of a web in cross direction. The drying cylinders are arranged as close together as possible so as to reduce the free draws to a minimum. The cylindric surfaces of the drying cylinders are axially extended to form cylindrical edge rings provided with radial holes communicating with a vacuum source in order to create a partial vacuum on the outside of the drying cylinder so that the web is sucked firmly towards this.

EP-87850093.3, publication number EP-238 470 (priority application SE-8601291) describes a device in a dryer section for controlling shrinkage or stretching of a web with the aid of two bands provided with adhesive material, said adhesive bands acting with outwardly directed forces on the edge portions of the web.

In so-called cylinder dryers where the paper web passes over one or more heated drums during the drying process, the shrinkage or stretching in longitudinal direction of the web can be controlled by controlling the velocity of the drums individually. However, this usually gives no control of shrinkage in cross-machine direction, thereby resulting in uneven properties in the paper. Classification of the paper must often be performed so that the mid-section and edge sections of the web are used for different purposes, or else a higher density must be used than would be justified for a part of the production so that the entire production will fulfill the requirements specified.

The techniques described for preventing or at least limiting the transverse shrinkage of a paper web during drying have proved to function satisfactorily. For this reason it has been impossible to make commercial use of the potential existing for savings in material by better exploitation of the bending stiffness, tensile stiffness, tensile strength and compression strength of the paper. The use of adhesive bands accompanying the paper web has been found in practice to cause difficulty in achieving sufficient service life for the bands. Furthermore, the repeated application at very short intervals of the adhesive material, requires very good dosing precision as well as sufficient and highly effective cleaning in order to prevent material collecting on the bands. The arrangement of suction zones at the end portions of drying cylinders located close together is probably a reliable method but to a certain extent it counteracts the actual drying process due to the extremely short length of the free draw between drying cylinders. It has been found that the water removal occurs to a very great extent in the free draws between the drying cylinders of a dryer section of conventional type. During passage over the cylinders the paper web is pressed between the wire and the cylinder and is strongly heated, thereby offering a potential for the removal of water which then occurs in the free draw between the drums. This becomes particularly noticeable if the region between the cylinders is force-ventilated by means of so-called pocket ventilation. Since shrinkage and water removal are intimately associated, a small amount of the shrinkage occurs upon passage over the drying cylinders and a larger amount upon passage of the free draw. This condition is emphasised even more by the fact that during passage of the cylinders the paper web is subjected to a not inconsiderable coercion caused by the pressure of the wire against the cylinder and the intermediate paper web. The use of methods and devices proposed earlier also requires conversion of the dryer section, or a new one must be constructed, since the drying cylinders must be provided with guide means for bands or with zones suitable for connection to a source generating a partial vacuum.

The present invention therefore provides a solution that can be applied in an existing dryer section with drying cylinders, without extensive alterations, and which with simple means prevents or limits shrinkage in the free draw where experience indicates that most of the shrinkage occurs. The invention thus offers a solution which, at low cost, gives most of the possible increase in paper quality discussed in SE-8400678-2.

The method according to the invention is characterized in that said partial vacuum is maintained along the edge portions of the web within substantially the entire free draw and is applied from the side of the drying wire facing away from the web so that the web is sucked firmly towards the drying wire by forces greater than the contracting forces acting in cross-machine direction, thereby counteracting shrinking, said partial vacuum being set within the interval 0.1–0.8 bar, preferably 0.2–0.5 bar.

The device according to the invention is characterized in that the suction means comprise elongate suction box members arranged to extend parallel to the edge portions of the web within substantially the entire free draw, that the suction box members have flat sides facing the drying wire and having opening means situated immediately beside the drying wire to generate partial vacuum in the drying wire opposite the edge portions of the web to suck the edge portions of the web firmly against the drying wire, and that the suction means are arranged to generate a partial vacuum lying within the interval 0.1–0.8 bar, preferably 0.2–0.5 bar.

In the patent specifications mentioned above it is shown that improved quality with regard to increased stiffness, for instance, can be achieved if shrinking is partially or completely prevented in a paper web, or is even replaced by a certain stretch. The method proposed by the present invention is considerably simpler than those mentioned earlier, thanks to the realisation that most of the web shrinkage occurs in the free draw between the drying cylinders. Besides shrinkage being somewhat impeded by the friction against the drying cylinders, this is because water removal occurs primarily where the paper web is moving through air that does not have such a high moisture content. According to the method proposed, therefore, shrinkage is prevented by applying extra forces only in the free draws, or at least during a considerable part of one or more free draws. The wire in the dryer section is utilised in order to apply counter-forces to the shrinkage forces, the edges of the paper web being sucked firmly towards the drying wire and the greater stiffness of the latter therefore preventing any decrease in the width of the web.

Within the scope of the invention it is of course also possible to divide the wire into longitudinal sections, the edge portions being separate and guided independently along the edge portions of the paper web. The concept of "wire" in this specification shall therefore be understood as a wire in the most general form. Particularly if the paper web has high grammage it may be advantageous to use separate edge portions for the drying wire.

The suction is achieved by arranging longitudinal suction boxes put under partial vacuum along both edge portions of the paper web on the side of the wire not supporting the paper web.

The efficiency in the action of contact between paper web and drying wire is dependent on the structure of the wire and the edge portions of the wire onto which the paper is to be sucked may therefore suitably be of a coarser structure than the central main part where fine structure may be desirable in order to obtain an acceptable paper surface. Furthermore, the wire may advantageously be sealed by means of longitudinal strips of silicon rubber or silicon resin that prevent or reduce gas flow inside the wire towards the suction boxes put under partial vacuum. The partial vacuum is maintained between 0.1 and 0.8 bar, preferably between 0.2 and 0.5 bar. The choice is dependent on the grammage of the paper web and the width of the area sucked towards the wire. This area need not exceed 100 mm for grammages normally occurring. The openings in the suction boxes may be in the form of one or more longitudinal or inclined slits or, for instance, circular holes arranged in one or several rows. The width of the slits or equivalent may then be between 20 and 40 mm.

It will be understood that the invention simultaneously solves the problem of web flutter, even in an improved manner, since the paper web is firmly suctioned all the way through the free draw along both side portions.

The invention will be described further in the following with reference to the drawings.

Figure 1:
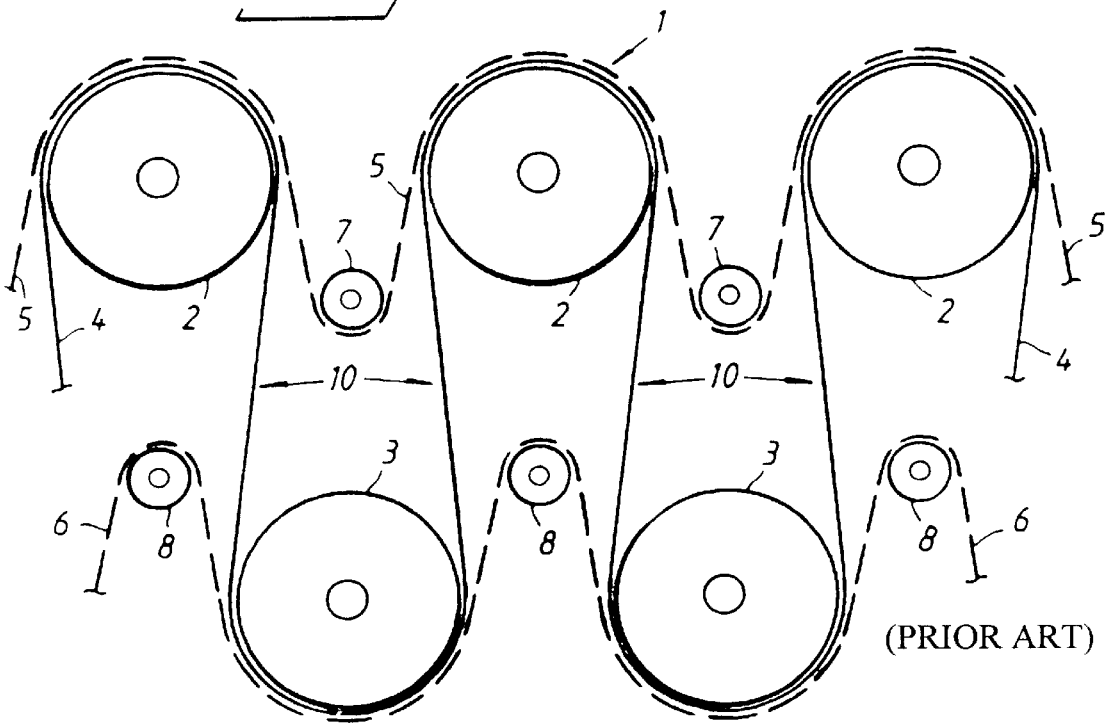
FIG. 1 shows parts of a known dryer section with drying cylinders and two drying wires.

FIG. 1 shows a dryer section 1 of a paper machine having upper and lower horizontal rows of drying cylinders 2, 3. A paper web 4 runs in meander fashion around the drying cylinders 2, 3 so that it encompasses substantially half of each drying cylinder 2, 3. The paper web 4 is pressed against the drying cylinders by upper and lower drying wires 5, 6 running each in its own loop over guide rolls 7, 8 in a zig-zag pattern around the drying cylinders 2 and 3, respectively, and pertaining guide rolls 7 and 8, respectively. The drying wires 5, 6 encompass a slightly smaller part of the drying cylinders 2, 3 than the paper web 4.

Figure 2:
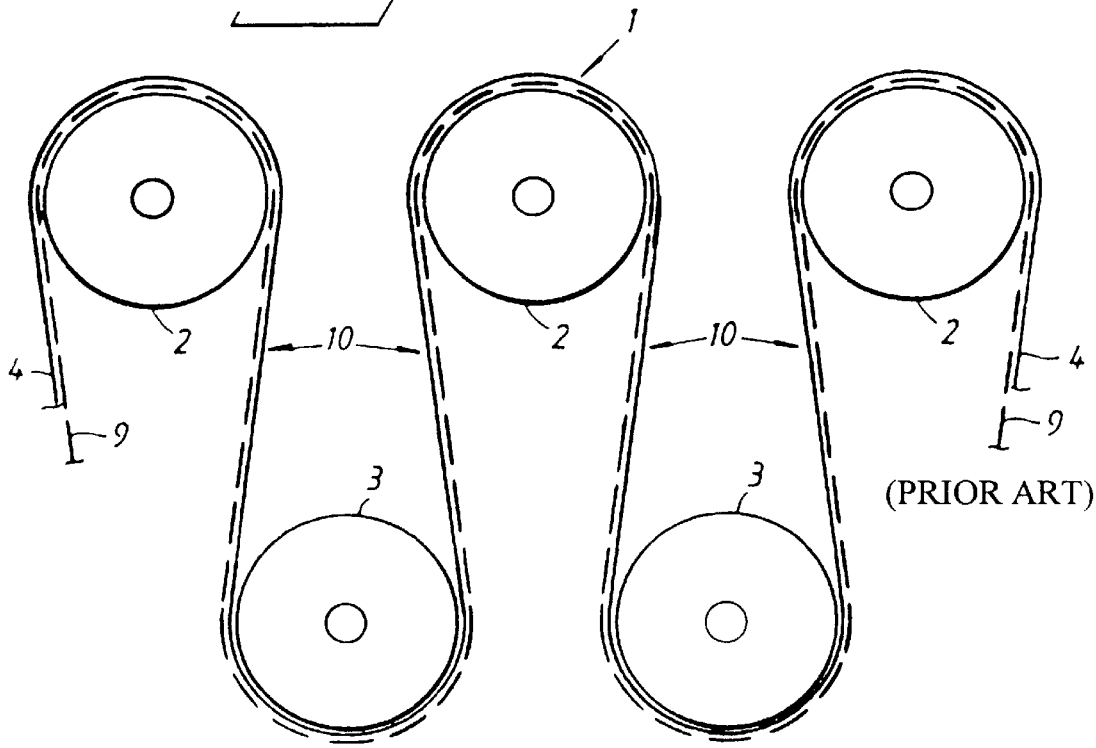
(PRIOR ART) Fig. 2
FIG. 2 shows parts of another known dryer section with drying cylinders and one drying wire.

FIG. 2 shows a dryer section of a paper machine that also has upper and lower horizontal rows of drying cylinders 2, 3. A paper web 4 runs in meander fashion around the drying cylinders 2, 3 so that it encompasses substantially half of each drying cylinder 2, 3 in the same way as in the dryer section according to FIG. 1. The upper row of drying cylinders 2 and the lower row of drying cylinders 3 have a common drying wire 9 running in a loop over outer guide rolls (not shown) and providing continuous support for the paper web 4. Upon passage of the upper row of drying cylinders 2 the drying wire 9 is situated between the paper web 4 and the cylindric surface of the drying cylinder 2, whereas it is situated on the outside of the paper web 4 upon passage of the lower drying cylinders 3, in order to press the paper web 4 against the drying cylinders 3.

Figure 3:
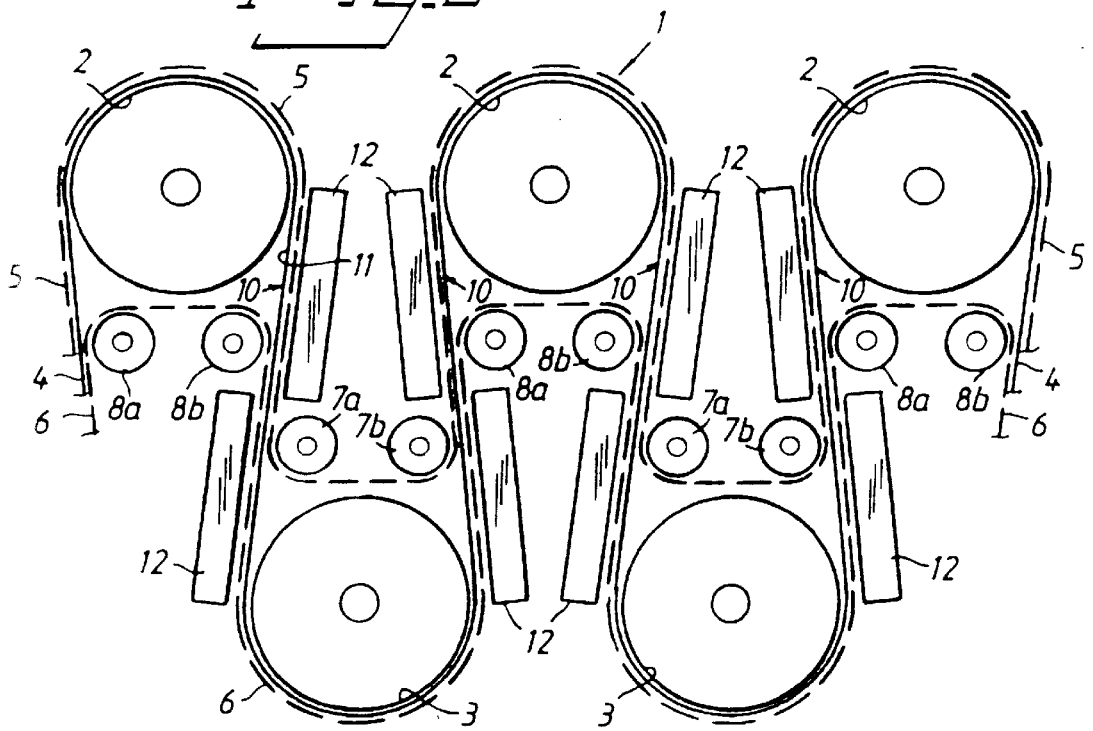
FIG. 3 shows the dryer section according to FIG. 1 after conversion in accordance with the present invention.

FIG. 3 shows a dryer section according to the basic embodiment in FIG. 1, but modified in accordance with the present invention. Between two adjacent drying cylinders 2, 3 in each row, the guide roll 7, 8 has been replaced by two guide rolls 7*a*, 7*b* and 8*a*, 8*b*, respectively, arranged close to the paper web 4 so that each drying wire 5, 6 accompanies the paper web along a larger or smaller part of the free draw 10 described by the paper web between two adjacent drying cylinders 2, 3, over which the paper web runs, each drying wire 5, 6 thus constantly accompanying the paper web around the drying cylinders 2 and 3, respectively, and encompassing as much of the drying cylinders 2 and 3, respectively, as the paper web 4. The guide rolls 7*a*, 7*b*, 8*a*, 8*b* also provide support for the paper web 4. The guide rolls 7*a*, 7*b*, 8*a*, 8*b* are thus located so that, within a portion of the free draw, the drying wires 5, 6 provide overlapping support for the paper web 4. The embodiment thus resembles the slalom wire embodiment shown in FIG. 2 where the paper web 4 is continuously supported by the single drying wire 9.

The dryer section is provided with suction means comprising a vacuum source (not shown) and elongate suction boxes arranged to extend parallel to the two edge portions 11 of the paper web along the free draw 10. In the embodiment shown in FIG. 3 each free draw is covered at each edge portion 11 of the paper web 4 by two suction boxes 12, arranged in displaced relationship to each other, one of each side of the paper web 4, close to the relevant drying wire 5, 6. The design of these suction boxes 12 is described in more detail in the following.

Figure 4:
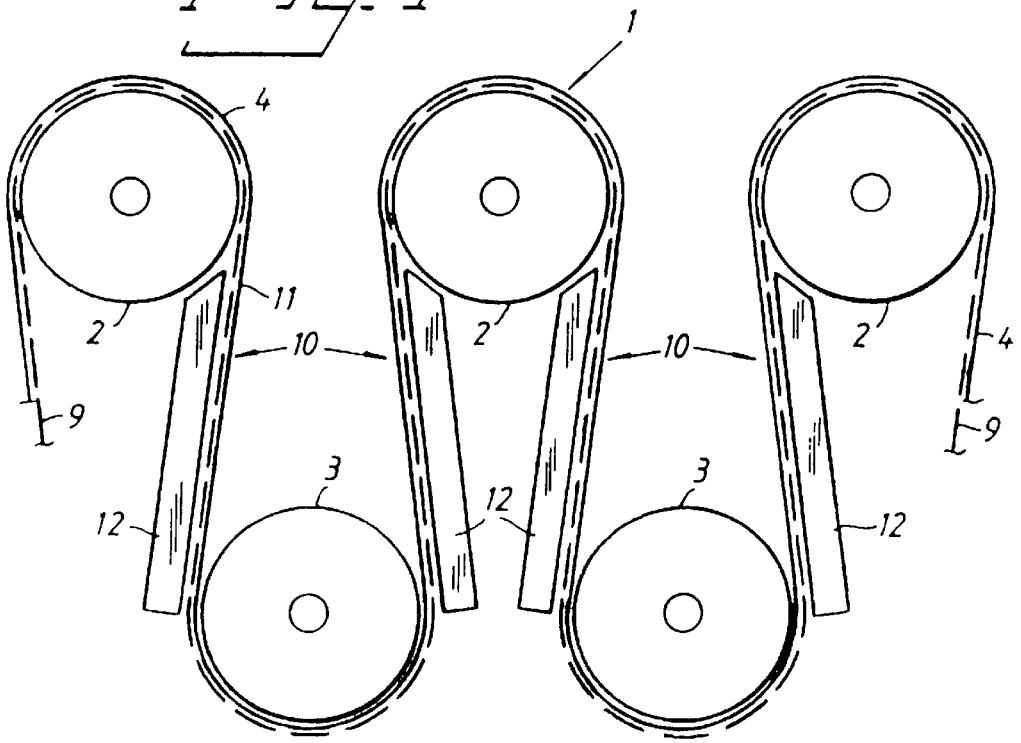
FIG. 4 shows the dryer section according to FIG. 2 after conversion in accordance with the present invention.

FIG. 4 shows a dryer section according to the basic embodiment in FIG. 2, but modified in accordance with the present invention. However, the loop of the drying wire 9 need not be altered. The dryer section is provided with suction means comprising a vacuum source (not shown) and elongate suction box members extending parallel to the two edge portions 11 of the paper web along the free draw 10. In the embodiment shown in FIG. 4 each free draw is covered at each edge portion 11 of the paper web by a single suction box 12, arranged close to the drying wire 9. The design of these suction boxes 12 is the same as the previous suction boxes, described in more detail in the following, with the exception of the length and that the suction boxes according to FIG. 4 have upper, pointed end portions in order to increase the suction area inside the wedge-formed pockets between the drying cylinders 2 and drying wire 9.

Figure 5:
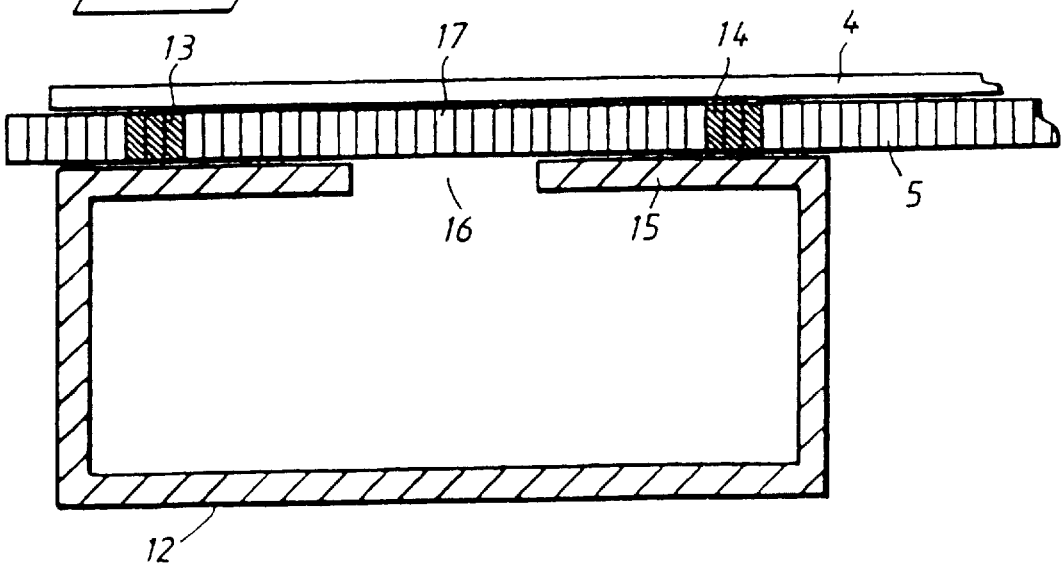
FIG. 5 shows a section through a drying wire, paper web and suction box according to the invention, the drying wire being provided with special seals.

FIG. 5 shows a simplified section through the edge portion 11 of the paper web 4 where it passes over a suction box 12 in the embodiments according to FIGS. 3 and 4. The drying wire 5, 6 or 9, made of woven polyester, has been provided with two longitudinal strips 13, 14 by impregnating it with silicon rubber or silicon resin. These strips 13, 14 act as seals enabling the partial vacuum in the suction box 12 to be maintained with less energy consumption since no air is drawn in through the drying wire parallel to its surface. They also constitute seals between the suction box 12 and drying wire that reduce the risk of air flowing in from the sides, as well as reducing wear and friction. The suction box 12 has a flat side 15 abutting the drying wire and provided with an opening means 16 situated immediately adjacent to the drying wire. In the embodiment according to FIG. 5 this opening means consists of a single longitudinal opening.

Figure 6:
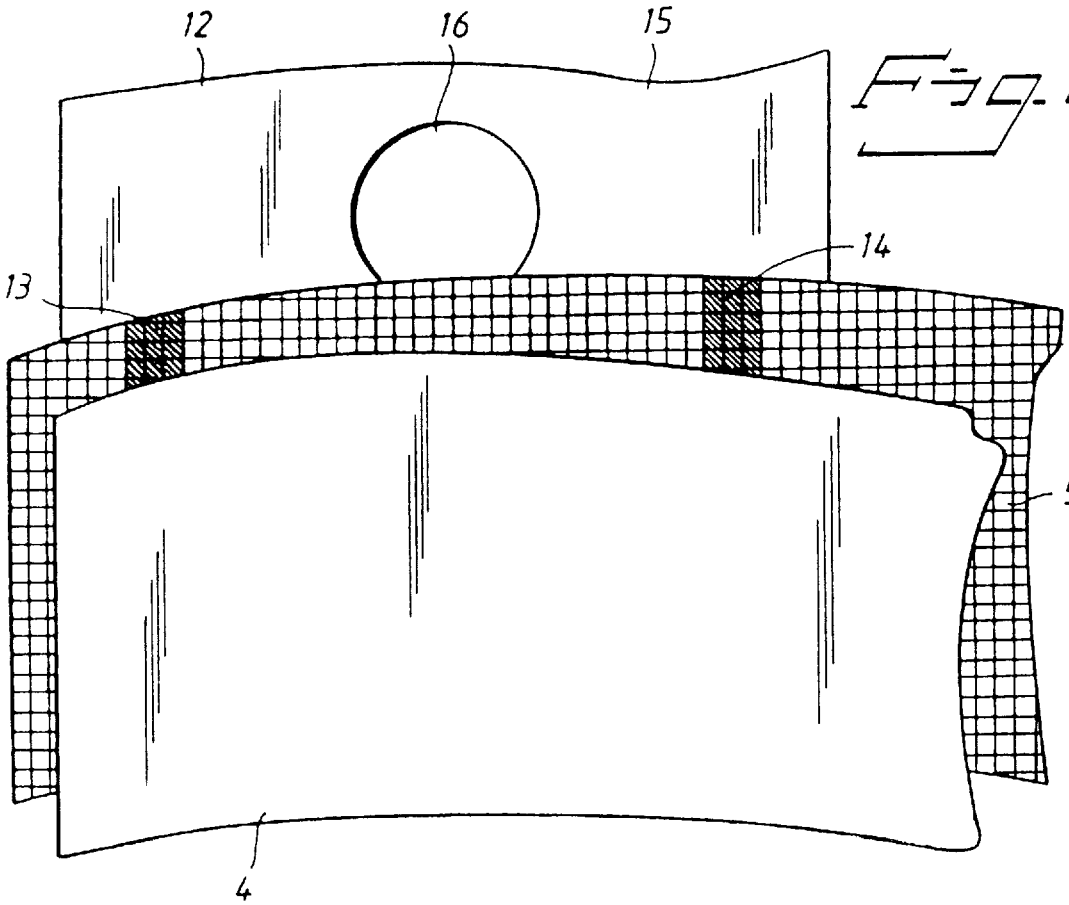
FIG. 6 shows an exploded part of a drying wire, paper web and suction box according to the invention.

FIG. 6 shows schematically an exploded part of the suction box 12, paper web 4 and drying wire 5, 6 or 9. The opening means 16 in this case consists of a plurality of circular holes in the side 15 of the suction box 12, air being drawn through the paper web 4, drying wire and into the suction box 12 via the holes 16.

Figure 7:
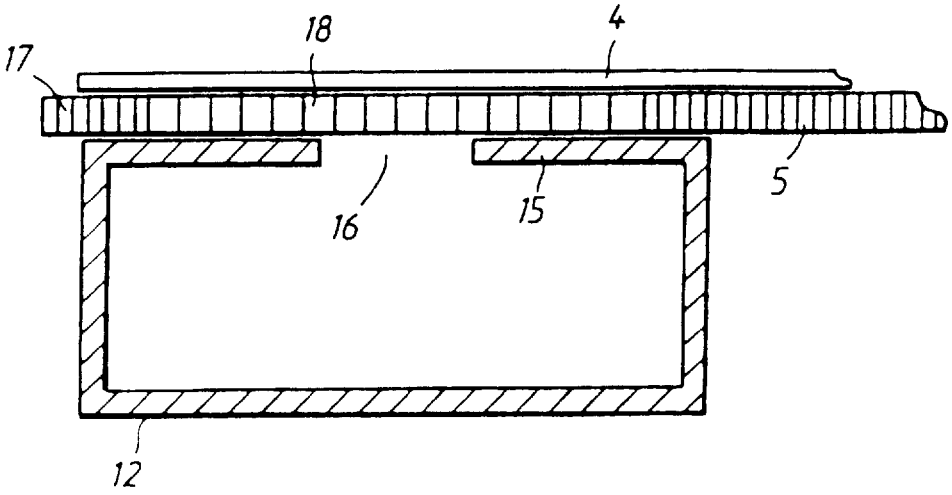
FIG. 7 shows a section through a drying wire, paper web and suction box according to the invention, the drying wire having a special area with coarser structure.

FIG. 7 shows a simplified section similar to that in FIG. 5, the drying wire in this case having a modified edge portion 17 comprising a longitudinal area 18 with coarser structure than the rest of the drying wire. The area 17 suitably has a width of less than 0.1 m.

Figure 8:
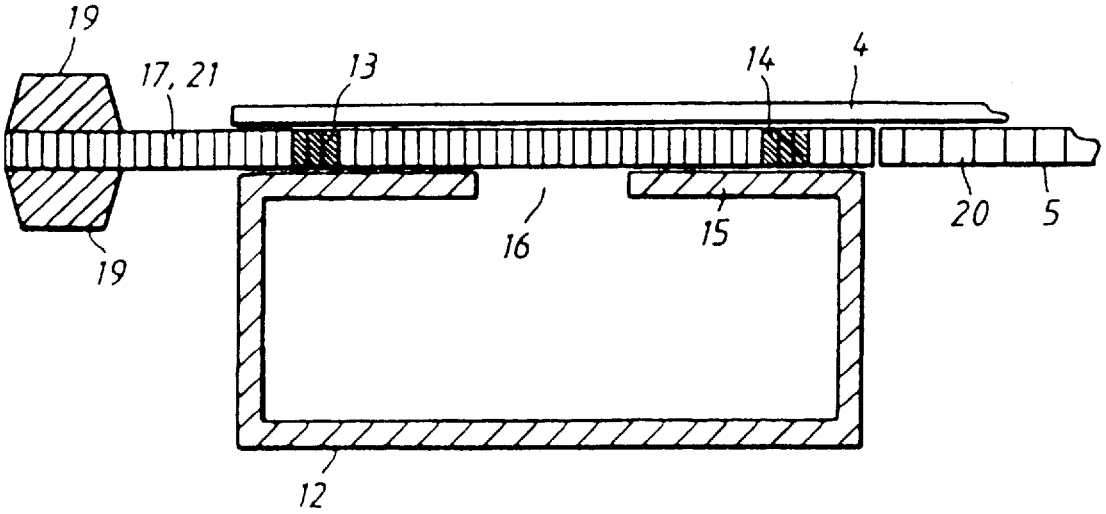
FIG. 8 shows an edge portion of a three-part drying wire and paper web and suction box according to the invention, the edge portion of the drying wire forming a free edge band with special guide strips.

FIG. 8 shows a simplified section through a suction box according to FIG. 5, but in combination with a drying wire divided into three portions comprising a larger, central main portion 20 and edge portions 17 in the form of free edge bands 21 with which the suction boxes 12 are arranged to cooperate. Each edge band 21 is provided with guide strips 19 close to its outer edges and on both sides of the edge band. These guide strips 19 are arranged to cooperate with corresponding peripheral circumferential grooves (not shown) in the cylindric surface of the drying cylinders 2, 3. Such an arrangement may be advantageously utilised in a dryer section according to FIG. 1, in which case the positions of the guide rolls 7, 8 need not be altered. The free edge bands 21 of the upper (or lower) drying wire thus accompany the paper web 4 continuously, whereas the mid-portion is carried to the guide roll 7 after having passed the drying cylinder 2. The lower (or upper) drying wire then has a width corresponding to said main portion 20.

The guide strips 19 may be constructed, for instance, as a plurality of rigid links with a length of between 2.5 and 5 cm, arranged in rows one after the other. When the edge band 21 is deflected by being bent along the periphery of a roll or cylinder, bending of the actual drying wire band occurs at a point mid-way between two adjacent upper and two adjacent lower link portions.

Although the invention has been described above with reference to the accompanying drawings showing some preferred embodiments of the invention, several modifications thereof are feasible within the scope of the following claims. By way of example it may be mentioned that the rolls designated 2 in FIGS. 2 and 4 need not constitute drying cylinders but may instead be unheated and may consist of suction rolls or other rolls with open, e.g. grooved, or smooth surface. Furthermore the constructions shown in FIGS. 2 and 4 may of course be inverted so that the drying cylinders 3 form an upper row and the rolls 2 a lower row, in which case the drying wire 9 will still press the web against the cylindric surface of the drying cylinders 3.

We claim:

1. A drying wire for the dryer section of a paper machine, said wire having a width defined by opposing longitudinal edge portions, each of said edge portions having a longitudinal area which is air impermeable while the rest of the drying wire is substantially air permeable, said area cooperating on one side with a suction member in order to suck the paper web against its other side and decrease shrinkage during drying of the web.

2. A drying wire as claimed in claim 1, wherein the longitudinal area with coarser structure is sealed against the adjacent parts of the drying wire by means of substantially gas-tight, longitudinal strips.

3. A drying wire as claimed in claim 2 wherein the longitudinal, substantially gas-tight strips extend through substantially the entire thickness of the drying wire.

4. A drying wire as claimed in claim 1, wherein the width of said area is less than about 0.1 m.

5. A drying wire as claimed in claim 1, wherein the wire is in three portions comprising a main mid-portion and two edge strips corresponding to said edge portions in an undivided drying wire, and that each of said edge strips is provided with guide strips close to its outer edges, arranged to cooperate with corresponding peripheral circumferential grooves in the cylindric surface of the drying cylinders of the dryer section.

6. A drying wire for the dryer section of a paper machine, said wire having a width defined by opposing longitudinal edge portions, each of said edge portions comprising substantially gas-tight, longitudinal strips defining between them an area that is air permeable and sealed from the adjacent parts of the drying wire and that is cooperating with a suction member to suck a paper web against its other side so as to decrease shrinkage of the web during drying.

7. A paper machine drying section comprising:

(a) at least one free draw that (i) is defined between at least two rolls, including at least one drying cylinder, and (ii) includes portions of one or more drying wires, which portions extend in the free draw; and (b) at least two suction members which provide a partial vacuum in the range of 0.1 to 0.8 bar and which are located relative to the portions of the drying wires such that longitudinal edge portions of a paper web present in the free draw are sucked against the drying wires by a force sufficient to reduce shrinkage of the paper web in the cross-machine direction as compared to the shrinkage that would occur in the absence of the partial vacuum.

8. A paper machine drying section comprising:

(a) at least one free draw that (i) is defined between at least two rolls, including at least one drying cylinder, and (ii) includes portions of one or more drying wires, which portions extend in the free draw; and (b) at least two suction members arranged relative to the portions of the drying wires in the free draw such that (i) longitudinal edge portions of a paper web present in the free draw are sucked against the drying wire by a force sufficient to reduce shrinkage of the web in the cross-machine direction as compared to shrinkage which would occur in the absence of the partial vacuum, and (ii) said drying wires are in contact with said suction members.

9. The drying section according to any one of claims 7–8, where the suction members are suction boxes.

10. The drying section according to claim 9, wherein the suction boxes are elongate suction boxes arranged to extend parallel to the edge portions of the web present in the free draw, said elongate suction boxes having flat sides facing the drying wire and opening means situated immediately adjacent to the drying wire to generate a partial vacuum in the drying wire at a location opposite the edge portions of the web.

11. A drying section according to claim 9, said suction boxes having a length substantially corresponding to the length of the free draw.

12. A drying section as claimed in claim 10 wherein the opening means is formed by at least one elongate slit extending between the ends of the suction box, or at least one row of holes or short, inclined slits, said row of holes or slits extending between the ends of the suction box.

13. The drying section according to any one of claims 7–8, wherein at least one free draw is defined by portions of two drying wires, and two suction members are associated with each of the drying wires.

14. The drying section according of claim 13, where the suction members are suction boxes.

15. The drying section according to any one of claims 7–8, wherein at least one free draw is defined by a portion of a single drying wire.

16. The drying section according to claim 15, where the suction members are suction boxes.

17. The drying section according to any one of claims 7–8, including at least two drying cylinders, with a free draw defined between two drying cylinders.

18. The drying section according to claim 17, where the suction members are suction boxes.

19. The drying section according to claim 18, wherein the suction boxes are elongate suction boxes arranged to extend parallel to the edge portions of the web present in the free draw, said elongate suction boxes having flat sides facing the drying wire and opening means situated immediately adjacent to the drying wire to generate a partial vacuum in the drying wire at a location opposite the edge portions of the web.

20. The drying section according to claim 18, wherein each edge portion of the drying wire comprises a longitudinal area having coarser structure than the rest of the drying wire, said longitudinal area being designed to cooperate on one side with the suction boxes to suck the paper web against its other side.

21. The drying section according to claim 20, wherein the longitudinal area with coarser structure is sealed against the adjacent parts of the drying wire by substantially gas-tight, longitudinal strips.

22. The drying section according to claim 18, wherein each edge portion of the drying wire comprises substantially gas-tight, longitudinal strips defining between them an area that is sealed from adjacent parts of the drying wire and is intended on one side to cooperate with the suction boxes to suck the paper web against its other side.

23. The drying section according to claim 22, wherein longitudinal, substantially gas-tight strips extend through substantially the entire thickness of the drying wire.

24. The drying section according to claim 22, wherein the width of said area is less than 0.1 m.

25. The drying section according to claim 18, wherein the drying wire has three separate portions comprising a main mid-portion and two edge strip portions.

26. The drying section according to claim 25 wherein each of said edge strips is provided with guide strips that are arranged to cooperate with corresponding peripheral circumferential grooves in the cylindric surface of the drying cylinders.

27. The drying section according to claim 17, comprising at least three drying cylinders and at least two free draws running between at least three drying cylinders.

28. The drying section according to claim 27, wherein each free draw includes a single drying wire.

29. The drying section according to claim 27, wherein each free draw includes portions of two drying wires, and two suction members are associated with each free draw.

30. The drying section according to claim 29, where the suction members are suction boxes.

31. The drying section according to claim 30, wherein the suction boxes are elongate suction boxes arranged to extend parallel to the edge portions of the web present in the free draw, said elongate suction boxes having flat sides facing the drying wire and opening means situated immediately adjacent to the drying wire to generate a partial vacuum in the drying wire at a location opposite the edge portions of the web.

32. The drying section according to claim 30, wherein each edge portion of the drying wires comprise a longitudinal area having a coarser structure than the rest of the drying wires, said area being designed to cooperate on one side with the suction boxes to suck the paper web against its other side.

33. The drying section according to claim 32, wherein the longitudinal area with coarser structure is sealed against the adjacent parts of the drying wire by substantially gas-tight, longitudinal strips.

34. The drying section according to claim 30, wherein each edge portion of the drying wires comprise substantially gas-tight, longitudinal strips defining between them an area that is sealed from adjacent parts of the drying wires and is intended on one side to cooperate with the suction boxes to suck the paper web against its other side.

35. The drying section according to claim 34, wherein longitudinal, substantially gas-tight strips extend through substantially the entire thickness of the drying wires.

36. The drying section according to claim 34, wherein the width of said area is less than 0.1 m.

37. The drying section according to claim 30, wherein a first of the drying wires has three separate portions comprising a main mid-portion and two edge strip portions.

38. The drying section according to claim 37 wherein each of said edge strip portions is provided with guide strips that are arranged to cooperate with corresponding peripheral circumferential grooves in a cylindric surface of the drying cylinders.

39. The drying section according to claim 37 wherein a second of the drying wires has a width corresponding to the main mid-portion of the first drying wire.

40. The drying section according to claim 39 wherein (i) said edge strip portions of said first drying wire accompany the web and are provided with guide strips that cooperate with peripheral circumferential grooves in a cylindrical surface of the drying cylinders, and (ii) the second drying wire and the mid-portion of the first drying wire are each guided by guide rolls in the free draw.

41. In a paper machine including a drying section having portions of one or more drying wires running in one or more free draws, the improvement comprising at least two suction members which provide a partial vacuum in the range of 0.1 to 0.8 bar and which are located relative to the portions of the drying wires in the free draws such that longitudinal edge portions of a paper web present in the free draw are sucked against the drying wires by a force sufficient to reduce shrinkage of the paper web in the cross-machine direction as compared to the shrinkage that occurs in the absence of the partial vacuum.

42. In a paper machine including a drying section having portions of one or more drying wires running in one or more free draws, the improvement comprising at least two suction members arranged relative to the portions of the drying wires in the free draws such that (i) longitudinal edge portions of a paper web present in the free draw are sucked against the drying wires by a force sufficient to reduce shrinkage of the paper web in the cross-machine direction as compared to shrinkage that would occur in the absence of the partial vacuum, and (ii) said drying wires are in contact with said suction members.

43. The paper machine according to any one of claims 41–42, wherein the improvement further comprises that the suction members are suction boxes.

44. The paper machine according to claim 43, wherein the suction boxes comprise elongate suction box members arranged to extend parallel to the edge portions of the web present in the free draw, said suction box members having flat sides facing the drying wire and opening means situated immediately adjacent to the drying wire to generate a partial vacuum in the drying wire at a location opposite the edge portions of the web.

45. The paper machine according to claim 43, wherein the improvement further comprises at least one free draw being defined between at least two drying cylinders.

46. The paper machine according to claim 45, comprising at least two free draws running between at least three drying cylinders.

47. The paper machine according to claim 46, wherein each free draw includes portions of two drying wires, and two suction members are associated with each free draw.

48. The paper machine according to claim 46, wherein the suction boxes are elongate suction box members arranged to extend parallel to the edge portions of the web present in the free draw, said suction box members having flat sides facing the drying wire and opening means situated immediately adjacent to the drying wire to generate a partial vacuum in the drying wire at a location opposite the edge portions of the web.

49. The paper machine according to claim 46, wherein each edge portion of the drying wires comprise a longitudinal area having coarser structure than the rest of the drying wires, said area being designed to cooperate on one side with the suction boxes to suck the paper web against its other side.

50. The paper machine according to claim 49, wherein the longitudinal area with coarser structure is sealed against the adjacent parts of each drying wire by substantially gas-tight, longitudinal strips.

51. The paper machine according to claim 46, wherein each edge portion of the drying wires comprise substantially gas-tight, longitudinal strips defining between them an area that is sealed from adjacent parts of the drying wires and is intended on one side to cooperate with the suction boxes to suck the paper web against its other side.

52. The paper machine according to claim 51, wherein longitudinal, substantially gas-tight strips extend through substantially the entire thickness of the drying wires.

53. The paper machine according to claim 51, wherein the width of said area is less than 0.1 m.

54. The paper machine according to claim 46, wherein a first of the two drying wires has three separate portions comprising a main mid-portion and two edge strip portions.

55. The paper machine according to claim 54 wherein each of said edge strip portions is provided with guide strips that are arranged to cooperate with corresponding peripheral circumferential grooves in the cylindric surface of the drying cylinders.

56. The paper machine according to claim 54 wherein a second of the two drying wires has a width corresponding to the main mid-portion of the first drying wire.

57. The paper machine according to claim 56 wherein (i) said edge strip portions of said first drying wire accompany the web, and are provided with guide strips that cooperate with peripheral circumferential grooves in a cylindrical surface of the drying cylinders, and (ii) the second drying wire and the mid-portion of the first drying wire are each guided by guide rolls in the free draw.

58. A method for drying a paper web in a paper machine comprising:

(a) running a paper web, together with at least portions of one or more drying wires, through one or more free draws; and (b) introducing a partial vacuum in the range of 0.1 to 0.8 bar within longitudinal edge portions of the paper web in the free draw so as to suck longitudinal edge portions of the web against the drying wire by a force sufficient to reduce shrinkage of the paper web in the cross-machine direction of the web as compared to the shrinkage that would occur in the absence of the partial vacuum.

59. A method as claimed in claim 1, wherein the paper web entering the dryer section has a dry solids content of between 40 and 90%.

60. A method for drying a paper web in a paper machine comprising:

(a) running a paper web, together with at least portions of one or more drying wires, through one or more free draws; and (b) using at least two suction members to provide a partial vacuum within longitudinal edge portions of the paper web in the free draw, such that (i) the longitudinal edge portions of the paper web are sucked against the drying wires by a force sufficient to reduce shrinkage of the paper web in the cross-machine direction as compared to the shrinkage that would occur in the absence of the partial vacuum, and (ii) the drying wires are in contact with the suction members.

61. The method according to claim 60, wherein the at least two suction members are suction boxes.

62. A method for reducing contraction of a paper web in the cross-machine direction during drying in a drying section of a paper machine comprising:

(a) running a paper web, together with portions of one or more drying wires, through one or more free draws in a drying section of a paper machine; and (b) introducing a partial vacuum in the range of 0.1 to 0.8 bar within longitudinal edge portions of the paper web in the free draws so as to suck longitudinal edge portions of the web against the drying wires.

* * * * *

UNITED STATES PATENT AND TRADEMARK OFFICE
CERTIFICATE OF CORRECTION

PATENT NO. : 5,864,965

DATED : February 2, 1999

INVENTOR(S) : Hansson et al.

It is certified that error appears in the above-identified patent and that said Letters Patent is hereby corrected as shown below:

Column 12, line 9, "claim 1" should read --claim 58--.

Signed and Sealed this

Sixth Day of July, 1999

*Attest:*

Q. TODD DICKINSON

*Attesting Officer*

*Acting Commissioner of Patents and Trademarks*